United States Patent [19]

Avery

[11] Patent Number: 4,535,655

[45] Date of Patent: Aug. 20, 1985

[54] ENGINE TURNING TOOL BRACKET

[76] Inventor: Robert C. Avery, 14 Penny La., Chicago Heights, Ill. 60411

[21] Appl. No.: 577,041

[22] Filed: Dec. 1, 1983

[51] Int. Cl.[3] ..... B25B 31/00

[52] U.S. Cl. ..... 81/484; 29/270; 29/283

[58] Field of Search ..... 81/3 R; 254/130; 29/281.6, 283, 270, 278, 267, 219, 220

[56] References Cited

U.S. PATENT DOCUMENTS

| | | | |
|---|---|---|---|
| 2,342,728 | 2/1944 | Erickson | 254/130 |
| 3,925,872 | 12/1975 | McDaniel | 29/267 |
| 4,190,931 | 3/1980 | Del Bianco | 81/3 R |

*Primary Examiner*—James L. Jones, Jr.

*Attorney, Agent, or Firm*—Sabin C. Bronson

[57] ABSTRACT

An apparatus useful for manually rotating a rotatable system, e.g., engine, located in a stationary housing having a hole therethrough, comprises a plate having at least one slot and being securable to the housing so that at least a portion of the slot extends into the space defined by the perimeter of the hole; and a bar having first and second ends, and being capable of being placed in the slot so that the first end contacts the system and the second end can be manually held. With the bar in this position, manually rotating the bar about the slot causes the system to rotate.

An improved method for manually rotating a system is also disclosed.

11 Claims, 4 Drawing Figures

ENGINE TURNING TOOL BRACKET

BACKGROUND AND SUMMER OF THE INVENTION

This invention relates to an apparatus useful for manually rotating a system. In particular, this invention relates to an apparatus useful for manually rotating systems, such as engines, clutches, transmissions and the like, to permit inspection and/or maintenance of the systems.

Very often, devices such as clutches, transmissions and various engines and the like, which rotate in use are located in a housing which remains stationary as the device rotates. One or more holes may be located in the housing to allow for limited visual inspection, and possibly maintenance, of the system. However, in order to inspect the device properly, it is necessary to rotate the device so that each part thereof, in turn, can be visually inspected through the hole or holes in the housing. In the past, manually rotating such devices has been difficult. Clearly, it would be advantageous to provide an improved apparatus and method to facilitate this rotating.

Therefore, one object of the present invention is to provide an improved apparatus useful for manually rotating a rotatable system.

Another object of the present invention is to provide an improved method for manually rotating a rotatable system. Other objects and advantages of the present invention will become apparent hereinafter.

An improved apparatus useful for manually rotating a rotatable system located in a stationary (relative to the rotation of the system) housing having a hole, preferably an inspection hole, therethrough has been discovered. This apparatus comprises a plate means and a bar means. The plate means has at least one slot, preferably a plurality of slots and more preferably three slots. The plate means is capable of being secured, preferably removably secured, to the housing so that at least a portion of the slot (or slots) extends into the space defined by the perimeter of the hole. The bar means has a first end and a second end. The bar means is capable of being placed at least partially in the slot so that the first end contacts the system and the second end is capable of being manually held. With the bar means in this position, manually rotating the bar means, e.g., about the slot in which the bar means is placed, causes the system to rotate as desired.

This apparatus has many uses. For example, it allows for improved ease in rotating an engine, e.g., a vehicle engine, to be manually rotated to get the clutch adjustment properly placed (accessible through the hole in the housing) for adjusting. The apparatus can also be used in the tuning up of the engine, the timing of the engine, adjusting of the valves, rotating of the engine for installing of rod and main bearings, the installing of the cam, crank, accessory shaft and idler gears, the installing of a fuel pump and many other purposes. For transmissions, the apparatus is useful in checking for gear lash, checking bearing and shaft play, installing or removing a U joint, checking a speedometer drive, etc. The present apparatus simplifies turning of the engine for many different engine, clutch and transmission adjustments. This apparatus eliminates the need for a second man inside the vehicle cab to turn the engine electrically. As noted above, the present plate means includes a plurality of slots. The bar means is preferably capable of being placed in any one of these slots. This feature allows for improved flexibility in providing for manual rotation of the system.

In another preferred embodiment, the present plate means is bolted to the housing. Also, it is preferred that the placement of the plate means relative to the housing hole is adjustable. For example, the plate means may include more than one set of bolt holes to provide for securement to the housing. This allows the user to adjust the placement of the plate means on the housing as desired to suit the particular application involved. Also, the plate means may be secured to the housing so that the slot or slots extend upward into the space defined by the perimeter of the hole or downward into such space, as desired. The present apparatus has a large degree of flexibility and is adaptable for many uses as required by the individual user.

BRIEF DESCRIPTION OF THE DRAWINGS

These and other aspects and advantages of the present invention are set forth in the following detailed description and claims, particularly when considered in conjunction with the accompanying drawings in which like parts bear like reference numerals. In the drawings:

DESCRIPTION OF THE PREFERRED EMBODIMENT

Figure 1:
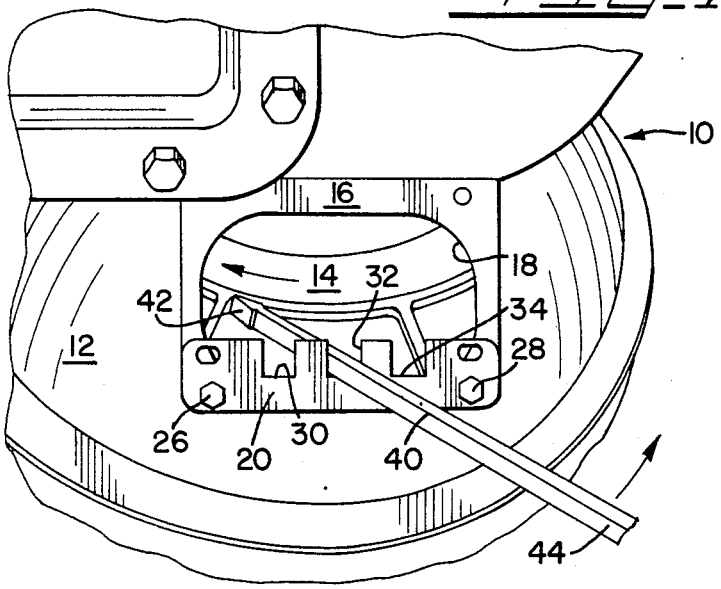
FIG. 1 is a partial plan view of a lower clutch housing illustrating one embodiment of the present invention.

Referring now to the drawings, truck engine, shown generally at 10, includes lower clutch housing 12, rotatable clutch 14, housing area 16 and inspection hole 18. Clutch housing 14, which includes housing area 16, is stationary relative to the rotation of clutch 14. Plate 20 is bolted to housing area 16 through lower bolt holes 22 and 24 by bolts 26 and 28. Plate 20 includes three slots 30, 32 and 34. Plate 20 is bolted to housing area 16 so that slots 30, 32 and 34 extend upwardly into the space defined by inspection hole 18. This is shown clearly in FIGS. 1 and 2.

Alternately, and if desired, plate 20 could be bolted to housing area 16 through upper bolt holes 36 and 38.

Figure 2:
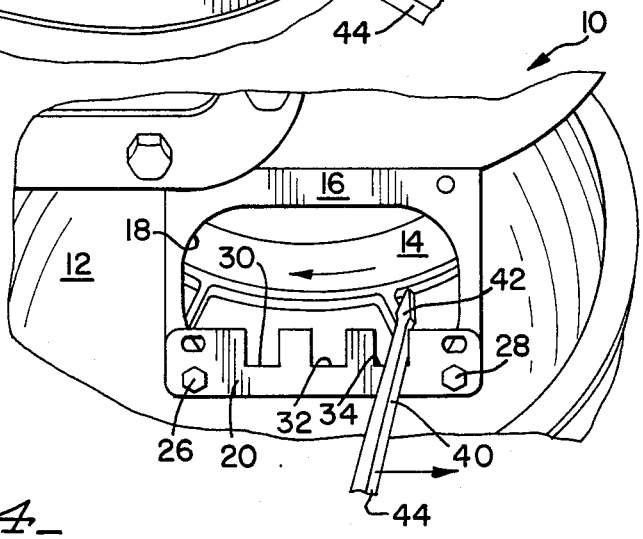
FIG. 2 is a partial plan view of a lower clutch housing illustrating the same embodiment as in FIG. 1 being used in a different manner.
Figure 4:
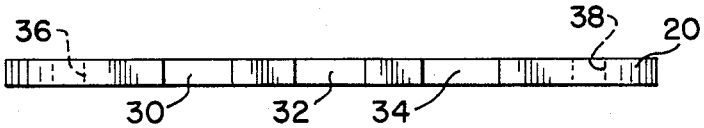
FIG. 4 is an elevational view taken along line 4—4 of FIG. 3.
Figure 3:
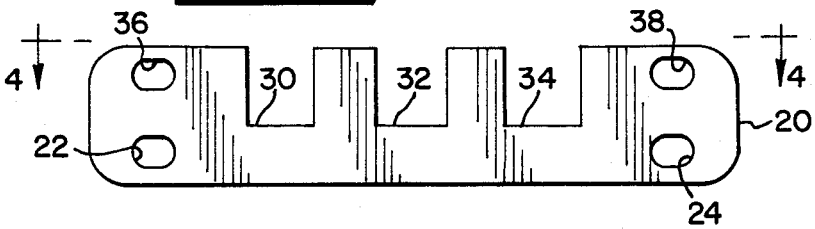
FIG. 3 is a front plan view of the plate of the embodiment of the present invention shown in FIGS. 1 and 2.

As shown in FIGS. 1 and 2, plate 20 is bolted to housing area 16 so that slots 30, 32 and 34 extend upwardly into the space defined by inspection hole 18. If desired, plate 20 could be bolted to the top of housing area 16 so that slots 30, 32 and 34 extend downwardly into the space defined by inspection hole 18.

Elongated bar 40 includes a first end 42 and a second end 44. The transverse cross section of elongated bar 40 is such that it fits completely in any one of slots 30, 32 and 34. For example, elongated bar 40 is shown in slot 32 in FIG. 1, and in slot 34 in FIG. 2. First end 42 of elongated bar 40 is designed to come into contact with rotatable clutch 14. In order to provide more precise contact between first end 42 and rotatable clutch 14, first end is tapered to a relatively fine contact line at the very tip of elongated bar 40. Second end 44 of elongated bar 40 is designed to be gripped by a human being.

The present turning apparatus comprised of plate 20 and elongated bar 40, functions as follows. Elongated bar 40 is placed in one of slots 30, 32 or 34 so that first end 42 comes in contact with the clutch bolt, boss or gusset or other suitable element of clutch 14. Second end 44 of elongated bar 4 is gripped by a human being who rotates elongated bar 44 about the slot in which elongated bar 40 is located. This rotation of elongated bar 40, in turn, causes clutch 14 to rotate, as desired, e.g., for inspection, adjustment and the like. The choice of which of slots 30, 32 or 34 to place elongated bar 40 in depends, at least in part, upon the amount of leverage needed to rotate clutch 14 and the availability of a suitable contact point on clutch 14 for first end 42. FIGS. 1 and 2 illustrate two alternatives.

While this invention has been described with respect to various specific examples and embodiments, it is to be understood that the invention is not limited thereto and that it can be variously practiced within the scope of the following claims.

What is claimed is:

1. An apparatus useful for manually rotating a rotatable system comprising a stationary housing having a hole therethrough and having said rotatable system located therein; plate means having a plurality of slots, said plate means being secured to said housing so that at least a portion of each of said slots extends into the space defined by the perimeter of said hole; and bar means having first and second ends, said bar means being capable of being placed at least partially in any of said slots so that said first end contacts said system and said second end is capable of being manually held, whereby manually rotating said bar means about said slot in which said bar means is placed causes said system to rotate.

2. The apparatus of claim 1 wherein said plate means has three slots.

3. The apparatus of claim 1 wherein said plate means is removably secured to said housing.

4. The apparatus of claim 1 wherein said plate means is bolted to said housing.

5. The apparatus of claim 1 wherein said housing has an engine therein.

6. The apparatus of claim 1 wherein said housing has a clutch or transmission therein.

7. The apparatus of claim 1 wherein each of said slots extends upward into the space defined by the perimeter of the hole.

8. The apparatus of claim 1 wherein each of said slots extends downward into the space defined by the perimeter of the hole.

9. The apparatus of claim 3 wherein the place on said housing to which said plate means is secured is adjustable.

10. The apparatus of claim 1 wherein said hole is an inspection hole.

11. A method for manually rotating a rotatable system located in a stationary housing having a hole therethrough and a plate secured thereto, said plate having a plurality of slots extending at least partially into the space defined by the perimeter of said hole, said method comprising; placing an elongated bar having first and second ends at least partially into any one of said slots so that said first end contacts said system; and manually rotating said bar about said slot in which said bar means is placed thereby causing said system to rotate.

* * * * *